United States Patent [19]

Jacques et al.

[11] Patent Number: 4,816,170

[45] Date of Patent: Mar. 28, 1989

[54] STABLE AQUEOUS FABRIC SOFTENING COMPOSITIONS BASED ON LECITHIN, SAPONIN AND SORBIC ACID AND METHODS FOR MAKING AND USING SAME

[75] Inventors: Alain Jacques, Blegny; Patrice Pirotton, Esneux, both of Belgium

[73] Assignee: Colgate-Palmolive Company, New York, N.Y.

[21] Appl. No.: 41,265

[22] Filed: Apr. 22, 1987

Related U.S. Application Data

[63] Continuation-in-part of Ser. No. 910,928, Sep. 24, 1986, which is a continuation-in-part of Ser. No. 896,912, Aug. 14, 1986, abandoned.

[51] Int. Cl.[4] ..... D06M 13/34; D06M 13/20

[52] U.S. Cl. ..... 252/8.8; 252/8.6

[58] Field of Search ..... 252/8.6, 8.8; 427/393.1, 389.9

[56] References Cited

U.S. PATENT DOCUMENTS 4,643,919 2/1987 Fu ..... 427/393.1

OTHER PUBLICATIONS

"Activity of the Saponins", E. S. Lower, The Eastern Pharmacist, Apr. 1985 pp. 55–58.

Chemical & Engineering News, Aug. 12, 1963.

*Primary Examiner*—Paul Liberman

*Assistant Examiner*—John F. McNally

*Attorney, Agent, or Firm*—N. Blumenkopf; M. M. Grill; R. C. Sullivan

[57] ABSTRACT

Stable easily pourable aqueous fabric softening compositions based on all natural ingredients, including lecithin as the fabric softening agent and sorbic acid as preservative and saponin as emulsifier are provided. The softening component comprises from about 2 to 20% by weight of the composition. Sorbic acid and saponin are present in amounts of 0.1 to 5% and 0.1 to 2%, respectively. The compositions are stable at pH's ranging from 4.5 to 5 and higher. Methods for making the composition are also described. Softening performance is comparable to that obtained by using quaternary ammonium compound softeners. The softener compositions are primarily intended for use in the rinse cycle of an automatic washing machine.

10 Claims, No Drawings

STABLE AQUEOUS FABRIC SOFTENING COMPOSITIONS BASED ON LECITHIN, SAPONIN AND SORBIC ACID AND METHODS FOR MAKING AND USING SAME

This application is a continuation-in-part of prior pending application Ser. No. 910,928 filed Sept. 24, 1986, which in turn is a continuation-in-part of prior pending application Ser. No. 896,912, filed Aug. 14, 1986, now abandoned.

The invention relates to fabric softening compositions adapted to be used in the rinse cycle of an automatic laundry washing machine. More particularly, this invention is concerned with aqueous fabric softening compositions which utilize natural ingredients to impart softness and other desirable attributes to the fabrics treated therewith. Specifically, the invention provides easily pourable stable aqueous compositions using lecithin as the active softening agent.

Compositions containing quaternary ammonium salts having at least one long chain hydrocarboxyl group such as distearyl dimethyl ammonium chloride or long-chain imidazolinium salts are commonly used to provide fabric softening benefits when employed in a laundry rinse operation; for example, see U.S. Pat. Nos. 3,349,033; 3,644,203; 3,946,115; 3,997,453; 4,073,735; and 4,119,545, among many others.

However, with the recent increasing importance of environmental awareness it has become desirable to reduce the harsh environmental impact of many synthetic chemicals including the cationic fabric softener compounds. To this end the present inventors have expended considerable effort to find a fabric softening agent which is based on "natural" products, namely a compound or composition which is present as such in nature without further chemical reaction to modify the chemical nature of the compound or composition. However, such natural product must necessarily be capable of providing softening performance at least comparable to present day cationic softeners and at reasonable cost.

As a result of their research, it has been found that lecithin, which is widely available in nature in such products as egg yolks, soya beans, blood, milk and others can be formulated into easily pourable, stable, water dispersible compositions containing such concentrations of lecithin as to provide softening performance comparable on an actual as well as on a cost basis with dimethyl distearyl (or ditallow) ammonium chloride, the two most frequently used cationic fabric softening agents.

The use of lecithin and lecithin derivatives in the textile industry has been known for at least 5 decades. B. Rewald in U.S. Pat. No. 1,946,332, issued Feb. 6, 1934, and in U.S. Pat. No. 2,020,517, issued Nov. 12, 1935 describes the use of aqueous emulsions of the phosphatides contained in vegetable seeds, especially soya beans, as dressing, sizing or softening oil in textile manufacture. The Schneider U.S. Pat. No. 2,069,971 describes the use of egg oil for the lubrication of textile yarns and filaments. Modified lecithin is mentioned as a lubricant or assistant for sizing agents in U.S. Pat. No. 2,621,133 to K. Gaver. A water-dispersible lecithin having surface active and antistatic properties is the subject matter of U.S. Pat. No. 3,257,331. A general overview is provided by Dr. E. W. K. Schwarz in "Lecithin From Soybean, Its Uses In The Textile Industry" Rayon Textile Monthly, May 1940, pages (63)295–(64)296. Recently issued U.S. Pat. No. 4,643,919 to Y.-C. Fu discloses textile treating compositions containing a mixture of from about 0.1 to 99% of a substantially water-insoluble cationic fabric softening agent and about 0.1 to 99% of a substantially saturated, phosphoglyceride-containing lipid component comprising at least about 50% by weight of an acetone-insoluble lipid material, the weight ratio of acetone-insoluble lipid to fabric softening agent being in the range of from about 0.01:1 to about 5:1. The compositions can be added to the rinse cycle in an automatic washing machine to impart softening benefits to textiles therein.

In our above-mentioned application, Ser. No. 910,928, the entire disclosure of which is incorporated herein by reference, we described aqueous dispersions of lecithin which were characterized by being stable, pourable at room temperature and dispersible in cold, warm or hot water, and having a pH in the range of from about 6.5 to 7.5. These compositions were prepared by adding lecithin to an alkaline aqueous bath and thereafter adding sufficient acid to reduce the pH to near neutral, i.e. pH 6.5 to 7.5. At final pH levels of below about 6, the stability of the dispersion was degraded to such an extent that after only a few weeks or less the lecithin would separate from the aqueous phase. However, it would be desirable to formulate the natural ingredient softener at pH's below about 6 in order to closely match the pH of natural skin.

Furthermore, although the aqueous lecithin dispersions at near neutral pH levels maintained their stability for periods of as long as several months or more it was observed that the lecithin, being a natural organic product, was subject to attack by various microorganisms, in some cases in as few as 3 to 4 days, thereby resulting in many cases in greatly shortened effective shelf lives independent of the stability of the dispersions.

The present invention has now solved both of these problems, namely pH dependence on stability and biodegradation of the lecithin active ingredient, while retaining the "all natural ingredient" character of our previous compositions.

Thus, the present invention provides stable aqueous dispersions of lecithin in which one or more water-soluble or dispersible natural product preservatives for inhibiting biodegradation of lecithin are included in the dispersion.

The present invention is based, in part, on the discovery that sorbic acid is an effective natural product preservative for inhibiting the microbial induced biodegradation of lecithin. The effectiveness of sorbic acid is, however, only exhibited at pH's of below about 6, that is, the sobic acid must be present in the free acid form and, therefore, requires acidic pH's.

Unfortunately, as described above, at pH's below about 6 the aqueous lecithin dispersions are not sufficiently stable and undergo phase separation.

This problem of phase separation at acidic pH's has been solved in accordance with another feature of the present invention, namely the discovery that the natural emulsifying agent, saponin, is effective in stabilizing the aqueous dispersions of lecithin and sorbic acid even at pH's below about 6. In fact, the saponins can effectively stabilize the aqueous lecithin dispersions over broad pH levels, such as from about 4 to about 12; however, in view of the acitivity of the sorbic acid preservative, pH's below about 6, especially from about 4.5 to 5 are preferred. Furthermore, this pH range also provides an optimum level with respect to matching the pH of normal skin and is, therefore, highly preferred for this reason, too.

Although not essential to achieve the foregoing objectives of product stability against phase separation and inhibition of microbial biodegradation, it has been found that the amount of sorbic acid which can be included in the fabric softening composition can be increased by incorporation of relatively small amounts of ethanol, sorbic acid being readily soluble in this alcohol but only sparingly soluble in water at ambient temperature, e.g. about 70° F. In addition, ethanol itself provides some additional antimicrobial activity.

Thus, the present invention provides stable aqueous dispersions of lecitin which are effective in imparting softness to fabrics treated therewith, especially in the rinse cycle of an automatic washing machine. The compositions according to the invention include the following ingredients in the following amounts:

| Ingredient | Amount - parts by weight | | |
|---|---|---|---|
| | Broad | Intermediate | Preferred |
| lecithin | 2–20 | 5–18 | 8–15 |
| sorbic acid | 0.1–5 | 0.15–1 | 0.20–0.40 |
| saponin | 0.1–2 | 0.1–1 | 0.20–0.40 |
| ethanol | 0–5 | 1–5 | 2–4 |
| water plus natural additives ← balance to 100 → | | | |
| pH | 4–12 | 4–6.5 | 4.5–5.0 |

Pure lecithin is a fatty acid substituted phosphatidylcholine having the general structural formula:

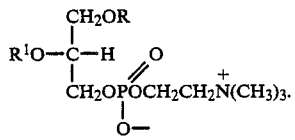

In practice, however, lecithin is rarely available in pure form and generally speaking, lecithin refers to a complex, naturally occurring mixture of phosphatides, triglycerides, carbohydrates, sterols and other minor ingredients.

Lecithin is generally obtained from vegetable oil with soybean oil being the principal source. Other vegetable oil sources of lecithin include corn oil, rapeseed oil, peanut oil, sunflower oil, safflower oil, etc. Other sources of lecithin include egg yolk, milk and animal brains. The phosphatides that are present in lecithin are similar except that their proportions vary. Similarly, the other minor constituents of lecithin vary according to the particular source.

Typical fatty acid profiles of commercially available lecithins are shown in the following table:

Comparative Fatty Acid Profiles (% by weight)

| Number of carbons and double bonds | Soybean Oil | Commercial Lecithin | Oil-Free Commercial Lecithin |
|---|---|---|---|
| saturated | | | |
| $C_{16:0}$ | 9 | 15 | 19 |
| $C_{18:0}$ | 5 | 5 | 5 |
| Total | 14 | 20 | 24 |
| unsaturated | | | |
| $C_{18:1}$ | 26 | 17 | 10 |
| $C_{18:2}$ | 53 | 55 | 59 |
| $C_{18:3}$ | 7 | 8 | 7 |

-continued

Comparative Fatty Acid Profiles (% by weight)

| Number of carbons and double bonds | Soybean Oil | Commercial Lecithin | Oil-Free Commercial Lecithin |
|---|---|---|---|
| Total | 86 | 80 | 76 |

A typical composition of soybean lecithin, the most common commercial product, is as follows:

| | % |
|---|---|
| Phosphatidyl choline (I) | 20 |
| Phosphatidyl ethanolamine (II) | 15 |
| Phosphatidyl inositide (III) | 20 |
| Phosphatic acids and other phosphatides | 5 |
| Carbohydrates, sterols | 5 |
| Triglycerides | 35 |

with

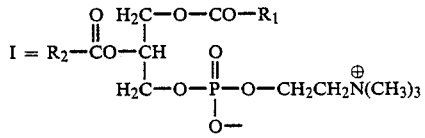

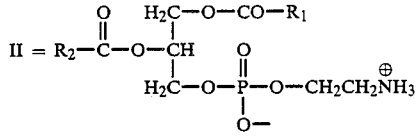

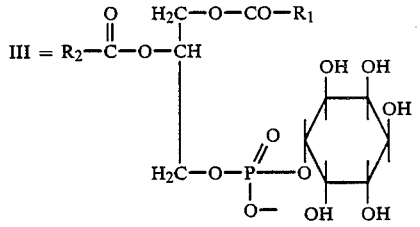

$R_1, R_2 = C_{16:0}, C_{18:0}, C_{18:1}, C_{18:2}, C_{18:3}$.

Any of these naturally occurring forms of lecithin can be used in the present invention. Furthermore, the lecithin need not be pure and any of the commercially available grades of lecithin which are generally mixtures of phosphatidylcholine, phosphatidylethanolamine, phosphatidylinositol (jphosphatides) and triglycerides, regardless of the source, e.g. egg yolk, soya beans, etc., can be used as the fabric softening agent in this invention.

Amounts of lecithin ranging from about 2 to about 20% by weight, preferably from about 5 to 18% by weight especially from about 8 to 15% based on the aqueous dispersion provide adequate levels of softening agent to impart fabric softness at the customary levels of usage for normal fabric loads in automatic laundry machines.

Sorbic acid (pentadiene carboxylic acid, $H_3C.CH:CH.CH:CH.COOH$) is a naturally occurring product found in unripe berries of mountain ash, *Sorbus aucuparia L;* and has been used as a preservative for certain food products. Sorbic acid is slightly soluble in cold water, more soluble in hot water and freely soluble in alcohol and ether. The effectiveness of sorbic acid as a preservative is only exhibited at acidic pH's, v12, below about 6, especially below about 5, at which the sorbic acid is present in the free acid form. At alkaline pH's the acid will ionize and associate with the cations present in the solution to form the corresponding sorbic acid salt which does not exhibit sufficient microbicidal activity.

Amounts of sorbic acid ranging from about 0.1 to 5%, preferably 0.15 to 1.0%, especially preferably 0.20 to 0.40%, are sufficient to inhibit the microbial induced degradation of the lecithin present in the dispersion as well as the saponin emulsifier-stabilizer.

Saponin is also present in the compositions of this invention and functions to maintain the stability of the lecithin dispersion at the low pH levels required for the sorbic acid preservative.

Saponins are sapogenin glycosides, each type consisting of a sapogenin (sapogenol), constituting the aglucon moiety of the molecule, and a sugar. Sapogenins may be of a steroid or a triterpene character, the sugar moiety being, for example, glucose, galactose, pentose, methyl pentose, and so on. A good review of the chemistry, activity, and uses of saponins is found in the article by Edgar S. Lower, "Activity of Saponins", The Eastern Pharmacist, April 1985, pages 55–58. Any of the various available forms of saponin can be used but the triterpene class of saponins, being more pH independent, are preferred.

The lecithin dispersions can be stabilized with as little as 0.1%, based on the total composition of saponin. However, for larger amounts of lecithin it is preferred to increase the saponin concentration up to about 2.0% by weight of the total composition. Generally, weight ratios of lecithin to saponin may vary from about 100:1 to 1:1, preferably 50:1 to 5:1, especially preferably from about 50:1 to 10:1. In terms of the total composition amounts of saponin may range, by weight, from about 0.1 to 2.0%, preferably 0.1 to 1.0%, and especially from about 0.20 to 0.40%.

An optional, but preferred component of the composition is ethanol to assist in solubilizing the sorbic acid preservative. When used amounts of ethanol up to about 5% are sufficient to promote the solubilization of the sorbic acid. No additional benefits are achieved at amounts above 5%, but rather the cost of the product increases unnecessarily. Thus, amounts of ethanol of from 1 to 5%, especially from 2 to 4%, by weight, based on the total composition are preferred. These amounts of ethanol correspond to weight ratios of ethanol to sorbic acid of from about 40:1 to about 1:1, preferably from about 30:1 to 3:1. If desired, part or all of the ethanol can be replaced by other alcohol such as isopropyl alcohol.

Also, as necessary, pH modifiers, such as sodiumcarbonate, citric acid and the like, can be added to raise or lower the pH of the composition.

The stable pourable aqueous dispersions can be simply prepared by the following procedure.

Water, preferably distilled, is heated to about 60° C. and the saponin is dispersed in the heated water. Separately, the lecithin is heated to about 50° to 60° C. until it has a honey-like consistency. The lecithin is then added to the saponin-water dispersion maintained at about 50° to 60° C. Next, a solution of the sorbic acid in ethanol is formed (or obtained as such) and added to the previously formed dispersion. As desired, other normal types of conventional additives, preferably also natural, can be added to the dispersion at this time. For instance natural essential oils in amounts up to about 2%, preferably 0.1 to 0.8% by weight based on the total composition can be used as perfume. Coloring agents such as chlorophyll can also be added, for example in amounts up to about 2%, preferably 0.5 to 1.5%, by weight based on the total composition. The entire mixture is then homogenized in an homogenizer mixture maintained at about 60° C. The resulting mixture is allowed to cool to room temperature and has a milky consistency and appearance.

The aqueous dispersions of lecithin are stable, fully biodegradable (after use or disposal), easily pourable and dispersible in cold, warm or hot water and when used in the rinse step of a laundry washing operation impart a feeling of softness to the treated fabrics.

The fabric softening compositions of this invention must have in addition to phase stability and storage stability, the requisite viscosity (i.e. for pourability) and water-dispersibility in the rinse cycle (or any other form of dilution prior to use) which consumers have come to accept and demand. Thus, the products contemplated herein may have viscosities ranging from about 30 cps to about 250 cps and preferably from about 40 cps to about 120 cps.

In use, the fabric softening composition is added to the rinse cycle in an automatic washing machine in an amount sufficient to provide from about 0.36 to about 22 grams lecithin per kilogram of fabric, preferably from about 1 to 15 grams lecithin per kilogram of fabric. Generally, this will correspond to from about 75 to about 150 milliliters of fabric softening compositiion, preferably about 100 to 120 ml, such as about 110 ml. Of course, the lecithin based softening formulations can also be used in the manual washing and softening of fabric materials, such as clothing, linens, towels and the like.

EXAMPLE

Typical fabric softening compositions according to the invention at different levels of lecithin are prepared as follows: A glass vessel equipped with a magnetic stirrer is filled with 86 grams distilled water and heated to raise the temperature of the water to 60° C. 0.3 grams of dry saponin powder (collected from various vegetables—obtained from Wr. Schmittmaun Co.—W. Germany) is added to the heated water with stirring. Soybean lecithin (0.3 grams) (available from Vamo Mills Kias) is added to the water-saponin solution with stirring continued. Separately a solution of sorbic acid in ethanol is prepared by adding 0.3 grams sorbic acid to 3.8 ml (3 grams) ethanol, and the resulting solution is added to the water-saponin-lecithin mixture. Then, 0.5 grams perfume is added to the resulting mixture. Throughout all of these mixing steps the temperature of the aqueous mixture is maintained between 50° and 60° C.

The resulting mixture, while maintained at approximately 40° C. to 70° C. is fed through a continuous high pressure homogenizer sold by Manton-gaulin (the mixture is forced through a first valve of less than 1 millimeter diameter at a pressure of about 300 kg/cm$^2$, then through a second valve to a receptacle at normal pressure, the whole procedure taking about 1 second or less). The resulting dispersion is allowed to cool to room temperature and has a milk-like appearance. The pH of the dispersion is 4.8. The dispersion can be stored at 30° C. for 3 months with no phase separation.

Following the procedure just described four different compositions are prepared with the amount of lecithin being varied to provide lecithin concentrations of 6.25 wt%, 10.0 wt%, 12.5 wt% and 15.0 wt%, based on the total composition.

The softening ability of each of these compositions according to the invention is evaluated by a panel of experts. Artifically hardened or desized cleaned cotton or terry towels rinsed with the lecithin dispersions at various concentrations, and air dried are used in the evaluations. The tests are carried out in an actual washing machine (Miele W756) on desized cotton terry towels which are washed with a commercial powder detergent at a level of 112.5 grams per 3 kilogram of towels. At each concentration the softening compositon is added in an amount of 110 milliliters. Evaluations are made at the end of 1 cycle, 2 or 3 cycles and 6 cycles. Ratings are given on the "Wixon" scale of 1 to 10 with 10 representing the highest softness or on the "Quat Scale", i.e. softness equivalent to Y% of ditallow dimethyl ammonium chloride. For comparison, a commercially available product, Axion 2, is used under the same conditions. The results are shown in the following table:

| Amount | Wixon Scale | | | Quat Scale | | |
|---|---|---|---|---|---|---|
| Lecithin (wt. %) | 1 cycle | 3 cycles | 6 cycles | 1 cycle | 3 cycles | 6 cycles |
| 6.25 | 5 | 6 | 7 | 2 | 2.5 | 2 |
| 10% | 8 | 7 | 8 | 3 | 3 | 2 |
| 12.5% | 6 | 9 | 6 | 2 | 2.5 | 2.5 |
| 15% | 6 | 6 | 6 | 2 | 2.5 | 2.5 |
| Axion 2 | | | | | | |

Unless otherwise noted, all percents and percentages are on a by weight basis.

Thus, it can be seen that the present invention provides an all natural ingredient biodegradable fabric softening composition which is comparable to the commercially available quaternary ammonium salt fabric softener compositions.

What is claimed is:

1. A stable, pourable aqueous liquid fabric softener composition comprising from about 2 to 20 percent by weight lecithin as fabric softening agent, from about 0.1 to 2 wt.% saponin as a pH independent emulsifier and stabilizer, from about 0.1 to 5 wt.% sorbic acid as a preservative, and from 0 to about 5 wt.% ethanol, the balance, comprising water.

2. The composition of claim 1 having a pH in the range of from about 4 to 5.5.

3. The composition of claim 2 wherein ethanol is present in amount of 1 to 5 wt.%.

4. The composition of claim 2 comprising, 5 to 18 wt.% lecithin, 0.15 to 1 wt.% sorbic acid, 0.1 to 1 wt.% saponin, 1 to 5 wt.% ethanol and water the .

5. The composition of claim 1 comprising 8 to 15 wt.% lecithin, 0.2 to 0.4 wt.% sorbic acid, 0.2 to 0.4 wt.% saponin, 2 to 4 wt.% ethanol and water, said composition having a pH in the range of from about 4 to about 5.5.

6. The composition of claim 1 further comprising natural essential oil as perfume.

7. The composition of claim 1 further comprising natural coloring agent.

8. A method for imparting softness to textile fabrics which comprises contacting the fabrics with the composition of claim 1.

9. The method of claim 8 wherein the fabric softening composition is used in the rinsing step of a laundry washing operation.

10. In a method of imparting softness to fabrics during the rinse cycle of an automatic laundry washing machine, the improvement comprising adding the composition of claim 1 in an amount sufficient to provide from about 0.36 to about 22 grams of lecithin per kilogram of fabric in the washing machine.

* * * * *